United States Patent [19]

Lemaster et al.

[11] Patent Number: 4,887,533

[45] **Date of Patent: * Dec. 19, 1989**

[54] APPARATUS AND METHOD FOR OSCILLATING THE FORM ROLLERS IN A PRINTING PRESS

[75] Inventors: Milton R. Lemaster, Dallas; Norman H. Kemp, Hurst, both of Tex.

[73] Assignee: AirSystems Inc., Dallas, Tex.

[ * ] Notice: The portion of the term of this patent subsequent to Jan. 12, 2006 has been disclaimed.

[21] Appl. No.: 253,776

[22] Filed: Oct. 5, 1988

Related U.S. Application Data

[63] Continuation of Ser. No. 909,898, Sep. 22, 1986, Pat. No. 4,777,877, which is a continuation-in-part of Ser. No. 858,944, May 2, 1986, Pat. No. 4,718,344.

[51] Int. Cl.[4] ..... B41F 1/16

[52] U.S. Cl. ..... 101/492; 101/148; 101/348; 101/DIG. 38

[58] Field of Search ..... 101/426, 348, 349, 350, 101/351, 352, 147, 148, 132.5, 130, DIG. 4, 384, 392, DIG. 38; 118/46, 113, 120, 122

[56] References Cited

U.S. PATENT DOCUMENTS

| | | | |
|---|---|---|---|
| 400,221 | 3/1889 | King | 101/DIG. 14 |
| 1,294,961 | 2/1919 | Schultz | 101/348 |
| 2,033,950 | 3/1936 | Morse | 101/DIG. 14 |
| 2,645,997 | 7/1953 | Grede | 101/348 |
| 3,062,138 | 11/1962 | Worthington | 101/350 |
| 3,283,741 | 11/1966 | Brodie | 101/350 |
| 3,343,484 | 9/1967 | Dahlgren | 101/148 |
| 3,625,148 | 12/1971 | Muselik et al. | 101/348 |
| 3,916,791 | 11/1975 | Simeth | 101/350 |
| 3,983,812 | 10/1976 | Schramm | 101/349 |
| 4,157,682 | 6/1979 | Mabrouk et al. | 101/148 |
| 4,231,292 | 11/1980 | Stolle | 101/148 X |
| 4,233,898 | 11/1980 | Dahlgren | 101/148 X |
| 4,397,236 | 8/1983 | Gretner et al. | 101/350 |
| 4,493,257 | 1/1985 | Kubert et al. | 101/349 |
| 4,546,701 | 10/1985 | Junghans | 101/DIG. 14 |
| 4,577,556 | 3/1986 | Fischer | 101/148 |
| 4,620,481 | 11/1986 | Steiner | 101/350 |
| 4,672,894 | 6/1987 | Hardin | 101/348 |
| 4,718,344 | 1/1988 | Lemaster | 101/348 |
| 4,739,703 | 4/1988 | Eguchi | 101/349 |
| 4,777,877 | 10/1988 | Lemaster | 101/426 |

FOREIGN PATENT DOCUMENTS

| | | | |
|---|---|---|---|
| 715278 | 9/1934 | United Kingdom | 101/147 |
| 1216330 | 12/1970 | United Kingdom | 101/148 |

*Primary Examiner*—E. H. Eickholt
*Attorney, Agent, or Firm*—W. Kirk McCord

[57] ABSTRACT

An apparatus and method for oscillating the ink form rollers and dampening form roller in a lithographic printing press to apply a smooth, relatively uniform coating of ink to the ink-receptive areas of the lithographic printing plate and to prevent ink from being transferred from the dampening form roller to the ink-rejecting areas of the printing plate. The ink form rollers and the dampening form roller are each mounted on a shaft rotatable about its own axis. The shaft has at least one shaft key for mating with a complementary keyway in a bushing which is inserted at least partially into the central opening of the corresponding roller. The engagement between the shaft key and the bushing keyway allows the roller and bushing to engage the shaft for common rotation while permitting the roller and bushing to slide axially with resepct to the shaft. First and second collar members may be disposed at respective predetermined locations on the corresponding shaft for limiting the axial movement of the corresponding roller between selected limits, although both the ink form rollers and the dampening form roller are preferably allowed to oscillate axially substantially the same distance in each direction as the corresponding vibrating roller by which the oscillating motion is imparted thereto.

18 Claims, 4 Drawing Sheets

APPARATUS AND METHOD FOR OSCILLATING THE FORM ROLLERS IN A PRINTING PRESS

This is a continuation of Applicant's co-pending patent application, Ser. No. 909,898, filed Sept. 22, 1986 (now U.S. Pat. No. 4,777,877), which is a continuation-in-part of patent application Ser. No. 858,944, filed May 2, 1986, which is now U.S. Pat. No. 4,718,344.

FIELD OF THE INVENTION

The present invention relates generally to lithographic printing press systems and in particular to a system and method for oscillating the ink form rollers and dampening form rollers along with the corresponding vibration rollers.

BACKGROUND OF THE INVENTION

An inker for a lithographic printing press includes an ink fountain having a rotatable fountain roller for picking up the ink from the fountain. The ink is transferred from the fountain roller by a plurality of ink distribution rollers, which in turn transmit the ink to a plurality of form rollers for applying the ink to the plate cylinder. The ink distribution rollers include vibrating rollers, which are in contact with respective ones of the ink form rollers and which oscillate axially as they rotate. Similarly, water is applied to areas of the plate cylinder where no image is desired to prevent the deposition of ink on those areas. Lithographic printing presses typically use a series of dampening rollers to pick up water from a pan or sump and transfer it to the plate cylinder.

"Ghosting" is a common problem encountered in such lithographic printing presses having an inker as described above. The ghosting problem results from ink starvation on certain areas of the plate cylinder. For example, when it is desired to print images in the same color and shade where the image is printed by at least two portions on the plate cylinder, one portion of which extends angularly relative to the other portion, one portion of the image will not be the same shade as the other portion. Thus, a distinct change in color occurs in the image, which is noticeable to the human eye. Typically, the portion of the image which is printed by the ink-receptive plate area of the greatest circumferential extent around the plate cylinder (the circumferential section of the plate cylinder having the greatest percentage of ink-receptive area) is lighter in shade than the other portion of the image and the change in shade occurs along a line.

Another problem commonly encountered in lithographic printing presses is the problem of "railroad tracking". This problem occurs when a dampening form roller picks up ink from the plate cylinder. during the rotation of the dampening form roller with respect to the plate cylinder, ink may be deposited on certain non-ink-receptive areas of the plate cylinder, thereby causing streaks of ink to be deposited on the plate cylinder, which results in such streaks appearing in unwanted areas on the final print product. Water streaks may also appear on the plate cylinder, which necessitates the use of alcohol and alcohol substitutes in the dampening fluid to break up the surface tension of the water and eliminate streaking.

DESCRIPTION OF THE PRIOR ART

Prior attempts to increase the amount of ink which is applied to the ink-receptive area of the plate cylinder which prints a portion of the image having the greatest circumferential extent around the plate cylinder have failed to solve the starvation problem. Such attempts have generally involved adjustments of the inker, changing the length and frequency of oscillation of the vibrating rollers and cocking the images, "double bumping" and the like.

Another technique, as described in U.S. Pat. No. 4,493,257, involves oscillation of one of the form rollers. The particular form roller which is oscillated is the last of the form rollers to be encountered by an area of the plate as it rotates. The oscillating form roller moves only about one-third ($\frac{1}{3}$) of the total axial movement of the corresponding vibrating roller.

While the technique of oscillating one of the form rollers described above is somewhat effective in solving the "ghosting" problem, ghosting will still occur on those areas of the image which are printed when the form roller is not oscillating. Furthermore, such printing presses often include three or four form rollers. Therefore, ghosting will continue to occur on those areas of the image imprinted by the non-oscillating form rollers.

The aforementioned problem of "railroad tracking" has not been adequately solved by the prior art. When tracking occurs, the printing press must be stopped long enough to clear the dampening form rollers to remove the ink. This is a cumbersome procedure and interrupts the printing operation.

OBJECTS OF THE INVENTION

It is, therefore, the principal object of the present invention to provide an improved system and method for oscillating the ink form rollers and the dampening form rollers in a lithographic printing press.

Another object of the invention is to provide a system and method for substantially eliminating the problems of ghosting and tracking in a lithographic printing press.

Still another object of the invention is to provide a system and method for providing a smooth, relatively uniform coating of ink on the plate cylinder in a lithographic printing press.

Yet another object of the invention is to improve the quality of the image printed by a lithographic printing press.

SUMMARY OF THE INVENTION

These and other objects are accomplished in accordance with the present invention wherein an apparatus and method for applying ink to the ink-receptive areas of a lithographic printing plate and for applying a dampening fluid to the ink-rejecting areas of a plate are provided. In one aspect of the invention an apparatus for applying ink to the ink-receptive areas of the plate is comprised of a shaft rotatable about its own axis; an elongated cylindrical roller having a central opening extending between opposite ends of the roller; and first and second bushings at least partially inserted into the central opening at the respective opposite ends of the roller. The roller is rotatable along with the shaft and is moveable along the axis of the shaft and includes a substantially cylindrical outer surface for contacting the printing plate and applying ink to the ink-receptive areas thereof when the roller is rotated about the axis of the shaft and is moved in an oscillating manner along the axis thereof. First and second bushings have respective openings for receiving the shaft therein to mount the roller on the shaft. The shaft has a substantially smooth elongated keyway disposed adjacent to a corresponding one of the first and second bushings so that the shaft key is substantially received within the central opening and the opening of the corresponding bushing. The corresponding bushing has an elongated keyway for receiving the shaft key to engage the shaft so that the roller and bushings rotate along with the shaft while allowing the roller and bushings to slide axially with respect to the shaft.

In another aspect of the invention an apparatus for controlling the application of ink to a printing plate in a lithographic printing press having ink distribution means for transferring ink from an ink source to ink-receptive areas of the printing plate and dampening roller means for transferring dampening fluid from a fluid source to ink-rejecting areas of the printing plate is comprised of a first vibrating roller; a plurality of ink form rollers disposed between the first vibrating roller and the printing plate and being in contact with both the first vibrating roller and the plate; means for rotating the first vibrating roller and moving the first vibrating roller axially to transfer ink to the ink form rollers; a second vibrating roller; a dampening form roller disposed between the second vibrating roller and the printing plate and being in contact with both the second vibrating roller and the plate; and means for rotating the second vibrating roller and for moving the second vibrating roller axially to transfer dampening fluid to the dampening form roller and to rotate and move the dampening form roller axially along with the second vibrating roller. At least two of the ink form rollers are moveable axially along with the first vibrating roller so that the ink form rollers apply a relatively uniform coating of ink to the ink-receptive areas of the printing plate. In one embodiment the form rollers which are moveable axially along with the corresponding vibrating rollers are those form rollers which are last to contact the printing plate during each rotational cycle thereof. In one embodiment the form rollers which are allowed to rotate and move axially along with the first vibrating roller are allowed to move substantially the same distance axially as the first vibrating roller in each direction. In another embodiment the dampening form roller is allowed to move substantially the same distance axially in each direction as the second vibrating roller.

In yet another aspect of the invention an apparatus for substantially preventing printing ink from being applied to ink-rejecting areas of a printing plate in a lithographic printing press is comprised of a shaft rotatable about its own axis and having an elongated shaft key disposed thereon; and dampening roller means concentrically disposed on the shaft. The roller means is comprised of an elongated cylindrical roller having a central opening extending between opposite ends of the roller and first and second bushing members partially inserted into the opening at the respective opposite ends thereof. The first and second bushing members have respective openings for receiving the shaft therein to mount the roller on the shaft. The first bushing member has an elongated keyway for receiving the shaft key to engage the shaft for common rotation therewith while allowing the roller and bushing member to slide axially with respect to the shaft. In one embodiment first and second collar members are disposed at respective first and second predetermined locations on the shaft for limiting the axial movement of the dampening roller means between selected limits.

BRIEF DESCRIPTION OF THE DRAWINGS

Other objects and advantages of the invention will be apparent from the detailed description and claims when read in conjunction with the accompanying drawings wherein:

DETAILED DESCRIPTION OF THE PREFERRED EMBODIMENT

In the description which follows, like parts are marked throughout the specification and drawings, respectively. The drawings are not necessarily to scale and in some instances proportions have been exaggerated in order to more clearly depict certain features of the invention.

Figure 1:
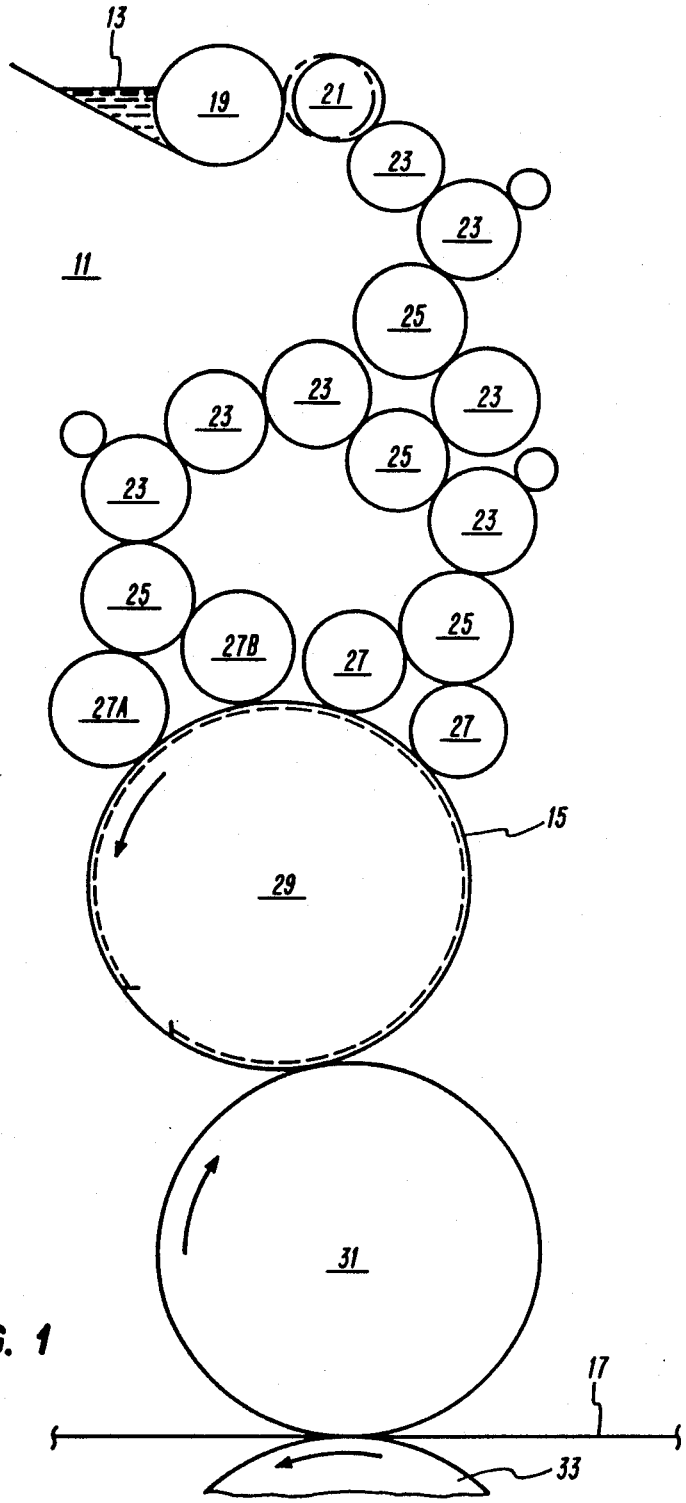
FIG. 1 is a schematic illustrating the ink distribution roller system in a lithographic printing press.

Referring to FIG. 1, an ink distribution system 11 for transferring printing ink from an ink fountain 13 to a printing plate 15 for printing an image on sheet 17 is depicted. Ink distribution system 11 includes an ink fountain roller 19, a ductor roller 21, six (6) distributor rollers 23, four (4) vibrating rollers 25 and four (4) form rollers 27.

As readily seen in FIG. 1, each of the four form rollers 27 is in contact with printing plate 15 at any given time at respective discrete positions along the circumference of printing plate 15. Printing plate 15 is disposed on a cylindrical plate 29 and is also in contact with first blanket cylinder 31, which transfers the image to be imprinted to sheet 17 as sheet 17 passes between blanket cylinder 31 and back cylinder 33.

Figure 4:
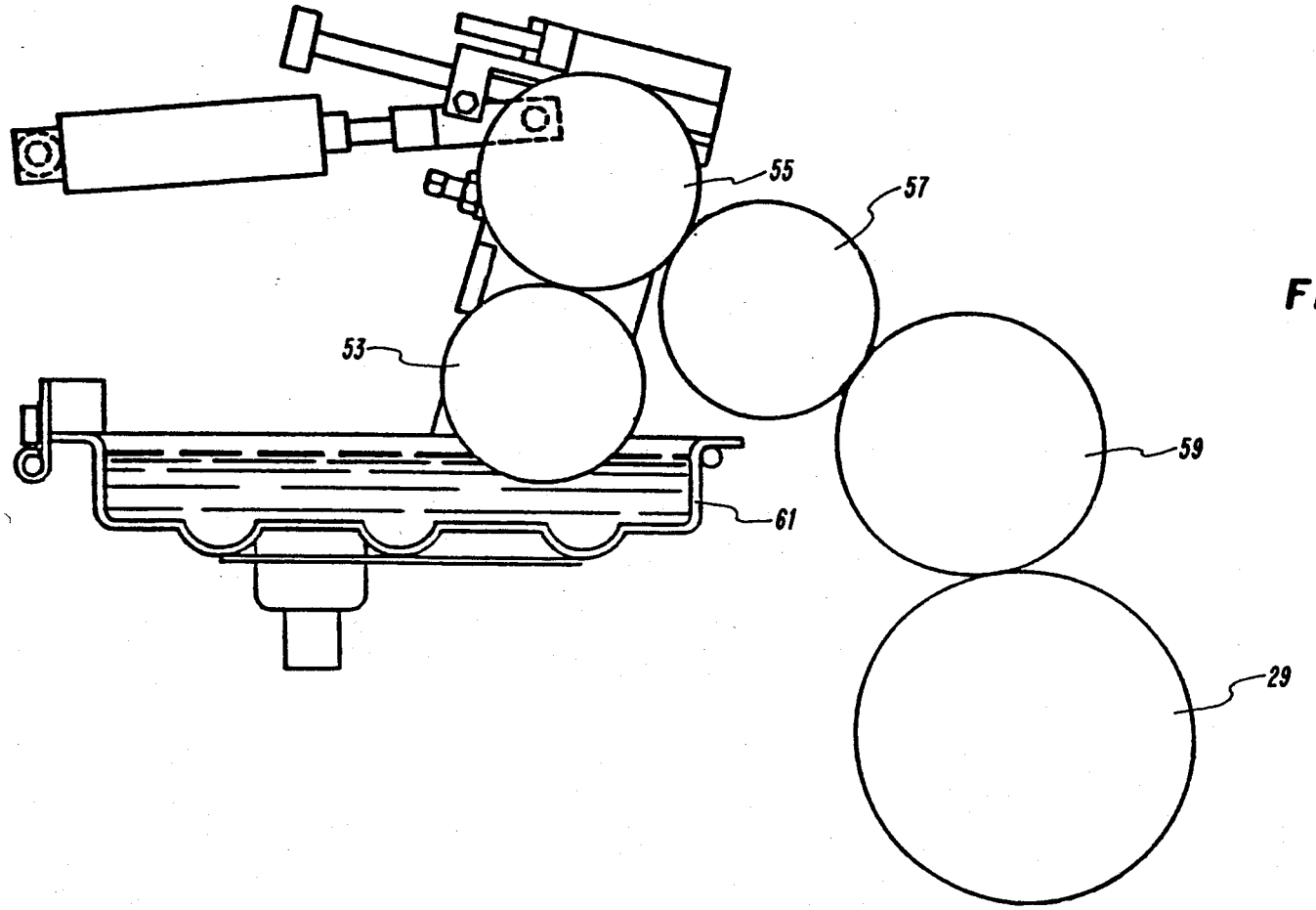
FIG. 4 is a schematic illustrating the dampening roller system in a lithographic printing press.
Figure 5:
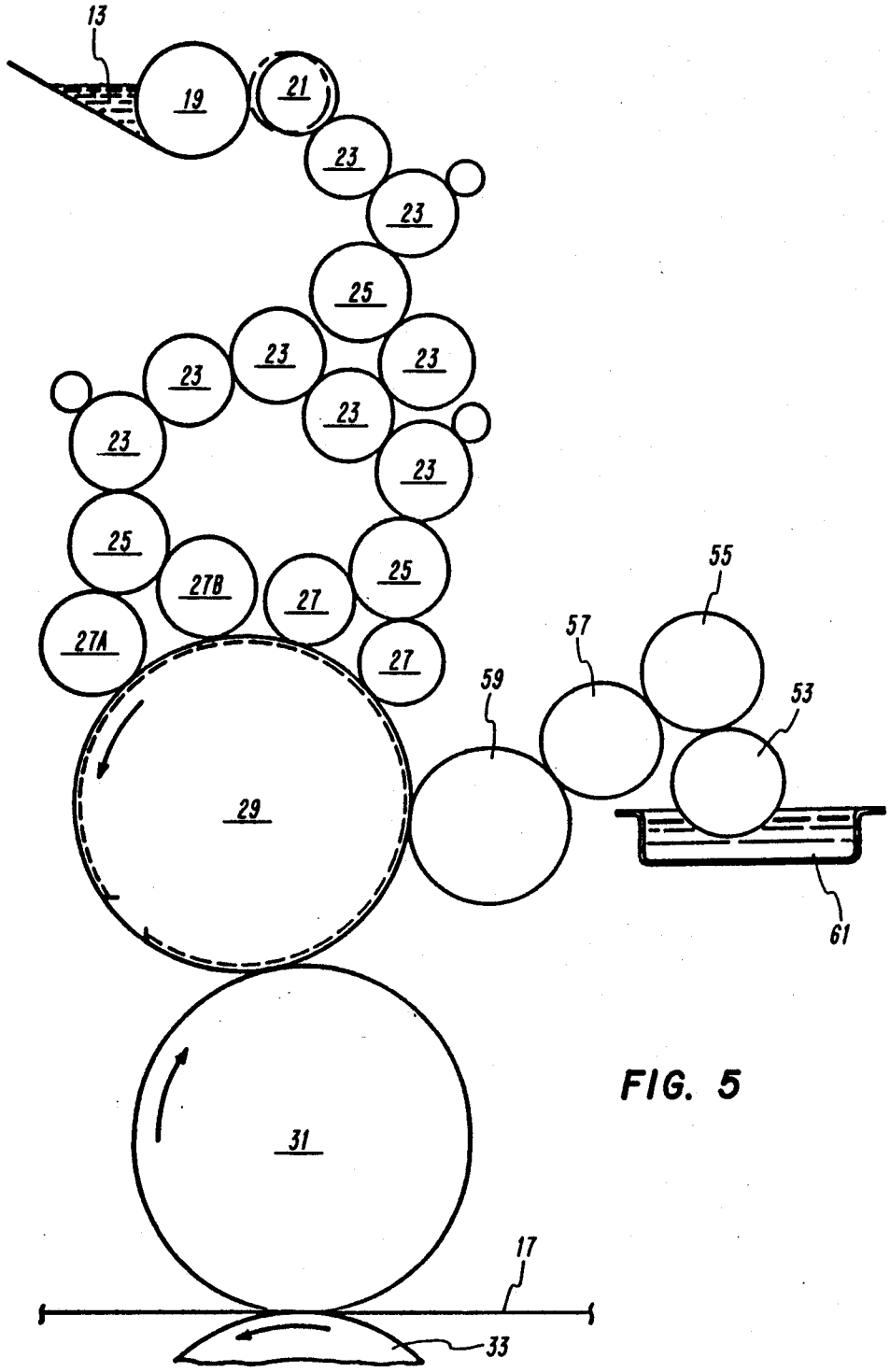
FIG. 5 is a schematic illustrating the ink rollers and dampening rollers in contact with the plate cylinder in a lithographic printing press.

One skilled in the art will recognize that printing plate 15 includes ink-receptive areas and ink-rejecting areas. The ink-rejecting areas of printing plate 15 are covered with a dampening solution, such as water, applied by a series of water rollers, which are best illustrated in FIGS. 4 and 5. The ink-receptive areas of plate 15 receive ink from the four (4) form rollers 27 as plate 15 is rotated by plate cylinder 29 in the direction indicated by the arrow in FIG. 1. The ink is then applied to first blanket cylinder 31, which in turn prints the images on sheet 17. Sheet 17 is moved through the printing press in the direction of the horizontal arrow above sheet 17. In many instances plate 15 has adjacent circumferential sections which are ink-receptive and frequently such sections extend circumferentially and axially different distances around plate cylinder 29.

The present invention allows a smooth, uniform coating of ink to be applied to the various ink-receptive areas of plate 15 so that there is no sharp difference in the shade of the color which is printed in different portions of the image. In accordance with the present invention form rollers 27 are mounted for axial movement along with the axial movement of the corresponding vibrating rollers 25. The axial movement of form rollers 27 occurs as a result of the pressure engagement with the corresponding vibrating rollers 25 while the form rollers 27 are in inktransmitting relationship with plate 15. The axial movement of form rollers 27 promotes the formation of a smooth film of ink on the ink-receptive areas of plate 15, thereby eliminating noticeable changes in color and intensity in the image imprinted on sheet 17.

Figure 2:
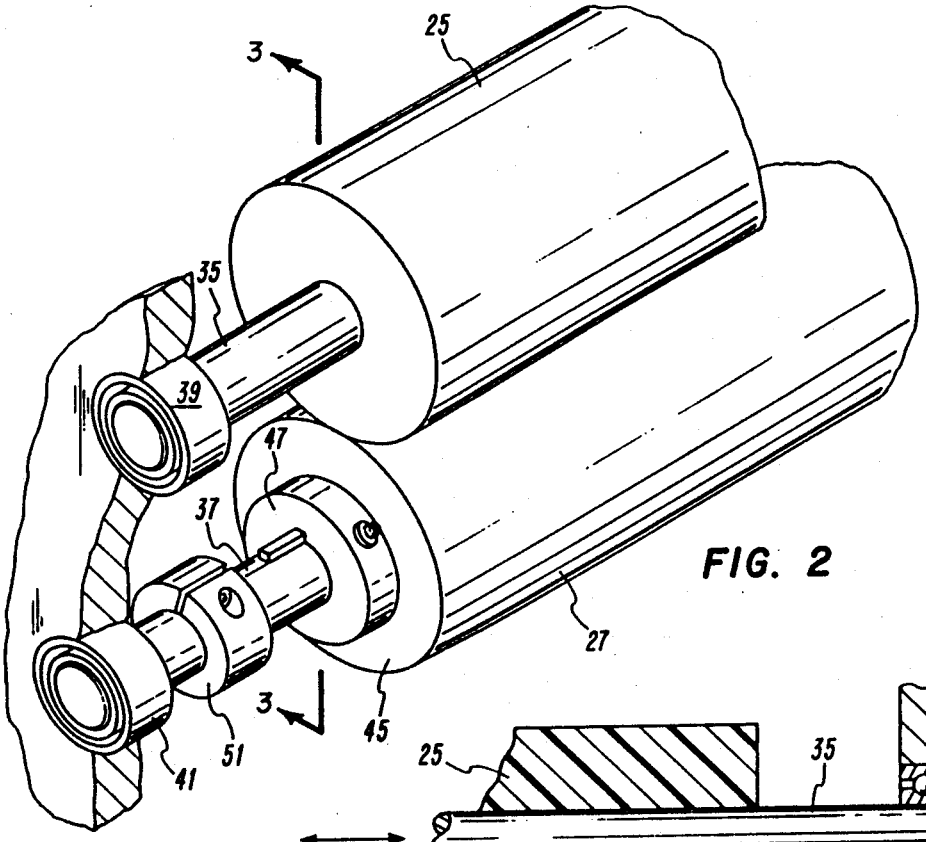
FIG. 2 is a perspective view of respective portions of a vibrating roller and form roller in a lithographic printing press according to the present invention.
Figure 3:
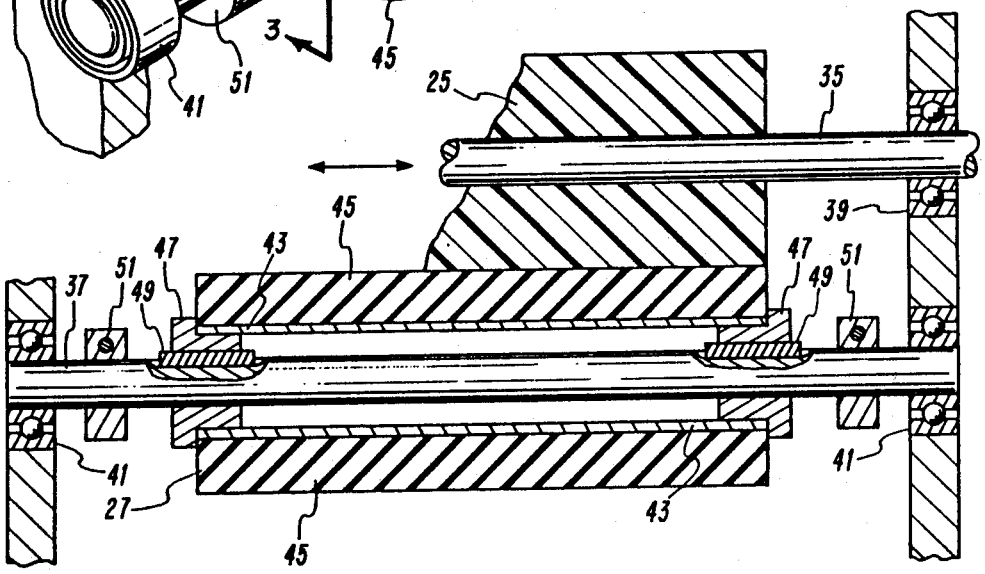
FIG. 3 is a sectional view of the vibrating roller and form roller, taken along the line 3—3 in FIG. 2.

Each vibrating roller 25 has a conventional drive system, which may include an electric drive motor and worm gear mechanism, associated therewith for moving the corresponding vibrating roller 25 back and forth in an axial direction. Such drive mechanisms are conventional and will not be described herein because they do not form a part of the present invention. Referring to FIGS. 2 and 3, each form roller 27 is in contact with a corresponding vibrating roller 25. Each form roller 27 is mounted so as to be rotatable and axially moveable substantially in unison with the corresponding vibrating roller 25. Thus, vibrating roller 25 acts as the drive roller and form roller 27 acts as the driven roller. Vibrating roller 25 is mounted in a fixed position on shaft 35 so that vibrating roller 25 rotates and moves axially together with shaft 35. Shaft 35 is rotated and moved in an oscillating manner along its axis by the conventional drive system discussed above, which in turn imparts rotational and axial motion to roller 25. Roller 25 is preferably comprised of a nylon or metal material.

Similarly, form roller 27 is mounted on shaft 37. Shafts 35 and 37 are journally supported at their respective opposite ends by bearings 39 and 41, respectively. Form roller 27 is preferably comprised of a hollow metal cylinder 43 surrounded by a cylindrical rubber covering 45. First and second bronze bushings 47 are partially inserted into metal cylinder 43 at respective opposite ends thereof and are in fixed engagement with form roller 27 so as to rotate and be axially moveable along therewith. Shaft 37 includes first and second shaft keys 49 at respective predetermined positions thereon for mating with complementary shaft keyways formed in bushing 47, thereby engaging form roller 27 for common rotation along with shaft 37, while allowing form roller 27 and bushings 47 to slide axially with respect to shaft 37. The length of each shaft key 49 is at least equal to the total axial distance which form roller 27 is moveable from the extreme left to the extreme right position as viewed in FIG. 2.

In FIG. 2, form roller 27 is shown in the extreme right position. First and second collars 51 are disposed at respective predetermined positions on shaft 37 to constrain the axial movement of form roller 27 within selected limits determined by the respective positions of first and second collars 51. Thus, the axial movement of form roller 27 may be controlled within desired limits, typically from 0 to $\frac{3}{4}$ inch in either direction. In the preferred embodiment, form roller 27 is allowed to move axially in each direction the same amount as the corresponding vibrating roller 25 to enhance the smooth transfer of ink to the ink-receptive areas of printing plate 15. Otherwise, if form roller 27 is allowed to remain stationary for a substantial length of time, ghosting will occur in the image printed by the plate areas in contact with form roller 27 while it is in a stationary position.

It has been determined that optimum print quality is achieved when at least two (2) of form rollers 27 are allowed to oscillate back and forth in the manner described above. The pair of form rollers which it is most desirable to rotate are those designated at 27A and 27B, which are those form rollers which contact printing plate 15 last during each rotation of plate 15. One skilled in the art will readily appreciate that all of the form rollers 27 may be allowed to move axially along with the corresponding vibrating rollers 25 to further enhance the application of a smooth, relatively uniform coating of ink to printing plate 15.

The combination of the rotational and axial movement of form roller 27 with respect to printing plate 15 causes the rubber surface of form roller 27 to move in a substantially helical pattern with respect to plate 15. It has been determined that the helical movement of form roller 27 across plate 15 does not increase the wear on plate 15. The cylindrical metal core of the roller is protected from wear by the bronze bushings. The rubber covering and bronze bushings can be replaced as dictated by wear without having to replace the remainder of the roller assembly. The apparatus according to the present invention substantially eliminates the ghosting problem without the need for complex and expensive equipment.

Referring to FIGS. 4 and 5, the system for transferring water to plate cylinder 29 is depicted. The water roller system is preferably comprised of a pan roller 53, a metering roller 55, a vibrator roller 57 and a dampening form roller 59. Pan roller 53 picks up water or other suitable fluid from a pan or sump 61, transfers it to metering roller 55, which in turn transfers the water to vibrator roller 57 and then in turn to dampening form roller 59, which deposits water on the non-ink-receptive areas of plate cylinder 29. Pan roller 53 and vibrator roller 57 are preferably comprised of a metal material such as chrome or a nylon material. Metering roller 55 and dampening form roller 59 are preferably comprised of a hollow metal cylinder surrounded by a cylindrical rubber covering.

In another aspect of the invention dampening form roller 59 is mounted for axial movement along with the axial movement of vibrator roller 57 in substantially the same manner as described above with respect to ink form rollers 27 and the corresponding vibrating rollers 25 with reference to FIGS. 1–3. The axial movement of dampening form roller 59 occurs as a result of the pressure engagement with vibrator roller 57 while dampening form roller 59 is depositing water or other suitable fluid on the ink-rejecting areas of plate 15. The axial movement of dampening form roller 59 dissipates ink picked up by dampening form roller 59 from plate 15 across the surface of form roller 59, thereby substantially eliminating streaking and "tracking" caused by ink build-up on a particular circumferential section of dampening form roller 59. Unless form roller 59 is oscillated along with vibrator roller 57, as described above, form roller 59 will continue to deposit ink on non-ink areas of plate 15, thereby causing a streak or track line to appear in the resultant print.

Vibrator roller 57 has a drive system, substantially as described above with reference to vibrating rollers 25. Form roller 59 is mounted so as to be rotatable and axially moveable substantially in unison with vibrator roller 57 so that vibrator roller 57 acts as the drive roller and form roller 59 acts as the driven roller. The system for mounting and oscillating vibrator roller 47 and form roller 59 is substantially the same as that shown and described with reference to FIGS. 2 and 3 for oscillating vibrating rollers 25 and ink form rollers 27, respectively. Form roller 59 is preferably oscillated the same distance in either direction as vibrator roller 57. In addition to substantially eliminating the aforementioned problem of streaking and tracking, the above-described "ghosting" problem is also substantially eliminated by oscillating ink form rollers 27 and dampening form roller 59 substantially in unison along with the corresponding vibrating rollers 25 and vibrator roller 57, respectively. Oscillation of dampening form roller 59 will also reduce the need for alcohol and alcohol substitutes to be used in the dampening fluid because the oscillation will provide a smooth application of dampening fluid on the plate cylinder, thereby substantially eliminating "water streaking".

Various embodiments of the invention have now been described in detail. Since changes in and modifications to the above-described preferred embodiment may be made without departing from the nature, spirit and scope of the invention, the invention is not to be limited to said details, except as set forth in the appended claims. For example, a single shaft key and keyway configuration may be used on both the ink form rollers and dampening form roller in lieu of the dual shaft key and keyway configuration described above.

What is claimed is:

1. A method for controlling the application of ink to the printing plate in a lithographic printing press, comprising the steps of:

providing ink distribution means for transferring ink from an ink source to the ink-receptive areas of the printing plate, said ink distribution means including a first vibrating roller and a plurality of ink form rollers disposed between first vibrating roller and being in contact with both the first vibrating roller and the plate;

providing dampening roller means for transferring dampening fluid from a fluid source to the ink-rejecting areas of the printing plate, said dampening roller means including a second vibrating roller and a dampening form roller disposed between the second vibrating roller and the plate and being in contact with both the second vibrating roller and the plate;

rotating the first vibrating roller about its major axis and moving said first vibrating roller in an oscillating manner along its major axis to transfer ink to the ink form rollers;

allowing at least two of said ink form rollers to rotate and move axially along with said first vibrating roller so that said ink form rollers apply a relatively uniform coating of ink to said printing plate;

rotating said second vibrating roller about its major axis and moving said vibrating roller in an oscillating manner along its major axis to transfer dampening fluid to said dampening form roller; and allowing said dampening form roller to rotate and move axially along with said second vibrating roller to dissipate ink picked up from said printing plate by said dampening form roller across the surface of said dampening form roller.

2. The method according to claim 1 wherein said at least two of said ink form rollers which are allowed to rotate and move axially along with said first vibrating roller are allowed to move substantially the same distance axially in each direction as said first vibrating roller.

3. The method according to claim 2 wherein said dampening form roller is allowed to move substantially the same distance axially in each direction as said second vibrating roller.

4. An apparatus for applying ink to the ink-receptive areas of a lithographic printing plate, said apparatus comprising:

a shaft rotatable about its own axis;

an elongated cylindrical roller having a central opening extending between opposite ends of said roller, said roller being rotatable along with the shaft and being moveable along the axis of the shaft, said roller having a substantially cylindrical outer surface for contacting said printing plate and applying ink to the ink-receptive areas thereof when said roller is rotated about the axis of the shaft and is moved in an oscillating manner along the axis thereof; and first and second bushings at least partially inserted into said opening at the respective opposite ends thereof, said first and second bushings having respective openings for receiving the shaft therein to mount the roller on the shaft, said shaft having a substantially smooth elongated shaft key disposed adjacent to a corresponding one of the first and second bushings so that said shaft key is substantially received within the central opening and the opening of the corresponding one of said first and second bushings, the corresponding one of said first and second bushings having an elongated keyway for receiving said shaft key to engage the shaft so that the roller and bushings rotate along with the shaft while allowing the roller and bushings to slide axially with respect to the shaft.

5. The apparatus according to claim 4 further including first and second collar members disposed at respective first and second predetermined locations on the shaft for limiting the axial movement of said roller between selected limits.

6. An apparatus for controlling the application of ink to a printing plate in a lithographic printing press having ink distribution means for transferring ink from an ink source to ink-receptive areas of the printing plate and dampening roller means for transferring dampening fluid from a fluid source to ink-rejecting areas of the printing plate, said apparatus comprising:

a first vibrating roller;

a plurality of ink form rollers disposed between said first vibrating roller and said printing plate and being in contact with both said first vibrating roller and said printing plate;

means for rotating said first vibrating roller and moving said first vibrating roller axially to transfer ink to said ink form rollers, at least two of said ink form rollers being movable axially along with said first vibrating roller so that said ink form rollers apply a relatively uniform coating of ink to the ink-receptive areas of the printing plate;

a second vibrating roller;

a dampening form roller disposed between said second vibrating roller and said printing plate and being in contact with both said second vibrating roller and said printing plate; and means for rotating said second vibrating roller and for moving said second vibrating roller axially to transfer dampening fluid to said dampening form roller and to rotate and move said dampening form roller axially along with said second vibrating roller.

7. The apparatus according to claim 6 wherein the form rollers which are movably axially along with the corresponding vibrating rollers are those form rollers which are last to contact the printing plate during each rotational cycle thereof.

8. The apparatus according to claim 6 wherein said at least two of said ink form rollers which are allowed to rotate and move axially along with said first vibrating roller are allowed to move substantially the same distance axially in each direction as said first vibrating roller.

9. The apparatus according to claim 8 wherein said dampening form roller is allowed to move substantially the same distance axially in each direction as said second vibrating roller.

10. An apparatus for substantially preventing printing ink from being applied to ink-rejecting areas of a printing plate in a lithographic printing press, comprising:

a shaft rotatable about its own axis and having an elongated shaft key disposed thereon; and dampening roller means concentrically disposed on said shaft, said roller means being comprised of an elongated cylindrical roller having a central opening extending between opposite ends of said roller and first and second bushing members partially inserted into said opening at the respective opposite ends thereof, said first and second bushing members having respective openings for receiving the shaft therein to mount the roller on the shaft, said first bushing member having an elongated keyway for receiving the shaft key to engage the shaft for common rotation therewith while allowing the roller and bushing members to slide axially with respect to the shaft.

11. The apparatus according to claim 10 wherein said shaft has first and second shaft keys disposed adjacent to the respective first and second bushing members, said first and second bushing members having respective first and second elongated keyways for receiving the respective first and second shaft keys to engage the shaft for common rotation therewith while allowing the roller and bushing members to slide axially with respect to the shaft.

12. The apparatus according to claim 10 further including first and second collar members disposed at respective first and second predetermined locations on the shaft for limiting the axial movement of said dampening roller means between selected limits.

13. Apparatus for applying a substantially uniform coating of ink to the ink-receptive areas of a lithographic printing plate, comprising:

a shaft rotatable about its own axis;

roller means concentrically disposed on the shaft and being rotatable with the shaft;

the roller means further being movable relative to the shaft along the axis thereof;

the roller means having a substantially cylindrical outer surface for contacting the printing plate and applying a substantially uniform coating of ink to the ink-receptive areas thereof when the roller means is rotated about the axis of the shaft and is moved in an oscillating manner along the axis of the shaft; and an oscillating roller having a substantially cylindrical surface in pressure engagement with the roller means outer surface, with the roller being disposed on the shaft such that rotating and axial movements of the oscillating roller are substantially imparted to the roller means for comovement therewith.

14. The apparatus of claim 13 further comprising at least one member disposed at a predetermined location on the shaft for limiting the axial movement of the roller means at a selected limit, thereby causing slippage between the roller means outer surface and the oscillating roller outer surface when the axial movement of the roller means is limited by the member.

15. The apparatus of claim 14 wherein the member is a collar fixed to the shaft.

16. The apparatus of claim 14 comprising first and second members disposed on the shaft at opposite ends of the roller means such that first and second limits of axial movement are established thereby.

17. The apparatus of claim 13 further comprising at least one tubular bushing mounting the roller means to the shaft.

18. The apparatus of claim 17 wherein the bushing includes at least one longitudinal keyway along an inner cylindrical surface thereof, and the shaft includes at least one key mated to the keyway, such that the roller means is moveable axially with respect to the shaft but is constrained for corotation with the shaft.

* * * * *